United States Patent [19]

Johnson

[11] 4,455,553

[45] Jun. 19, 1984

[54] SMOKE DETECTOR OF THE IONIZATION TYPE

[75] Inventor: Robert E. Johnson, Pembroke, Mass.

[73] Assignee: Pyrotector, Inc., Hingham, Mass.

[21] Appl. No.: 378,400

[22] Filed: May 17, 1982

[51] Int. Cl.[3] ..... G08B 17/10

[52] U.S. Cl. ..... 340/629; 250/381

[58] Field of Search ..... 340/527, 628, 629, 661; 250/381, 382, 384, 385, 388

[56] References Cited

U.S. PATENT DOCUMENTS 3,745,552 7/1973 Wilt ..... 340/527 X 4,151,522 4/1979 Yamauchi ..... 340/628 X 4,266,220 5/1981 Malinowski ..... 340/629 X

*Primary Examiner*—John W. Caldwell, Sr.

*Assistant Examiner*—Daniel Myer

[57] ABSTRACT

An ionization type smoke detector (10) includes a chamber having a measuring electrode (12), the voltage on the measuring electrode being a function of the concentration of smoke in the chamber, and further includes a comparison device (A3) for comparing the voltage measured on electrode (12) at two different times, and an output device (K) for producing an output signal if the voltages differ by a predetermined value.

7 Claims, 2 Drawing Figures

SMOKE DETECTOR OF THE IONIZATION TYPE

BACKGROUND OF THE INVENTION

Smoke detectors of the ionization type are well recognized for their ability to detect fast developing fires, which have little smoke, but produce large quantities of small product of combustion particles. However such detectors are often unable to detect, in a reasonable time, fires of the slow smouldering type, which produce large quantities of smoke, but a lesser amount of small product of combustion particles than a fast developing fire. Therefore such detectors are less effective than optical detectors in detecting slow smouldering fires, and some manufacturers cannot meet the requirements of some regulatory bodies that establish standards of performance of smoke detectors.

SUMMARY OF THE INVENTION

This invention provides an ionization detector which is capable of detecting smoke from a slow smouldering fire in less than one half of the time required for detection of such fires by previously known ionization detectors.

An ionization detector chamber is provided with an internal measuring electrode in the usual manner, so that the voltage on said electrode varies with the smoke concentration in the detector chamber. The voltage of the measuring electrode is periodically applied to a sample and hold circuit, and the voltage at the sample and hold circuit is compared with the subsequent voltage on the measuring electrode during a predetermined subsequent time period. If the smoke concentration is increasing, the voltage of the chamber electrode will, on each sample be less than the previous measuring electrode voltage which has been stored in the sample and hold circuit.

If the voltage difference between the chamber electrode voltage and the voltage at the sample and hold circuit exceeds a predetermined value during said predetermined time period, a pulse is provided to a counter. If a predetermined number of sequential voltage samples produce voltage differences that exceed said predetermined amount, an output alarm signal is generated.

A separate channel may be provided from the measuring electrode which responds to fast developing fires in the usual manner.

DESCRIPTION OF THE ILLUSTRATED EMBODIMENT

Figure 1:
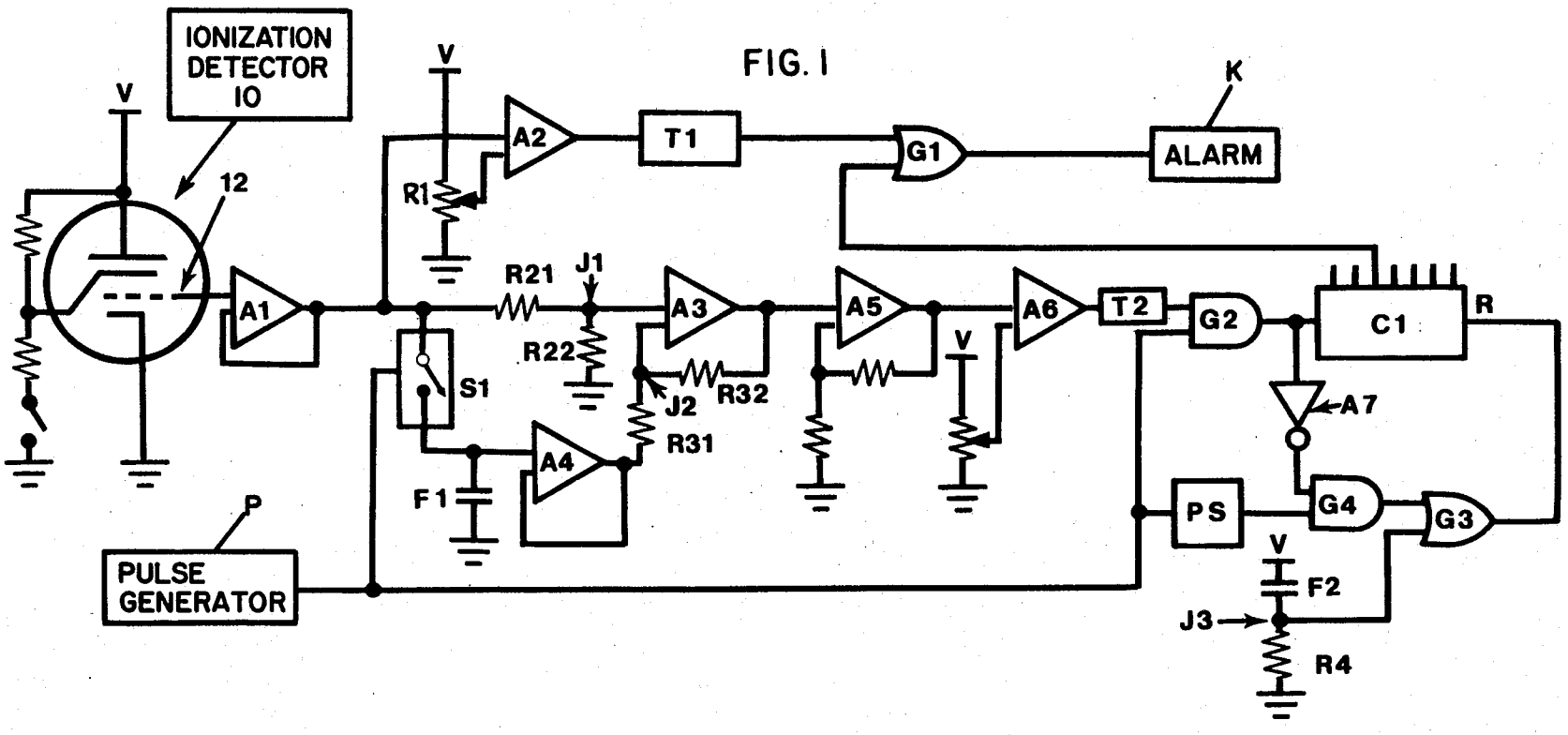
FIG. 1 is a schematic diagram of the electrical circuit of an ionization detector embodying the features of the invention.

Referring to FIG. 1 of the drawing, there is illustrated an ionization detector 10, which may be of the dual chamber type, with a measuring electrode 12. The detector is provided with an ionization source (not shown), and a D.C. voltage supply V in the usual manner so that the voltage on the measuring electrode 12 decreases with increasing smoke concentration. A buffer amplifier A1 receives the voltage of the measuring electrode, and the output of amplifier A1 is fed to two independent channels for actuating an alarm K when a predetermined change in voltage occurs at the measuring electrode.

The first channel comprises a differential comparator A2, a delay circuit T1, and an OR gate G1, the output of which is fed to the alarm K. The first channel operates in a known manner, causing the alarm to become energized when the voltage of the measuring electrode 12, which is fed to a first input of a differential comparator A2, rises to a predetermined value for a predetermined time. Said predetermined value may be adjusted by adjusting resistor R1, providing a reference voltage at the second input of the differential comparator A2.

The second channel is designed to actuate the alarm before the measuring electrode voltage reaches the voltage at which the first channel causes the alarm to be actuated, provided that the rate of increase of smoke concentration (as indicated by the voltage of the measuring electrode) exceeds a predetermined rate for a predetermined period of time.

For this purpose, the output of amplifier A1 is fed to the top of a voltage divider comprising resistors R21, R22, which are of equal value. The voltage at the junction J1 of the voltage divider is connected to a first terminal of a differential amplifier A3. The output of A1 is also fed through an electronic switch S1 to a sample and hold circuit, comprising a capacitor F1 and buffer amplifier A4, the output of which is fed to an end of a voltage divider comprising resistors R31, R32, which are of equal value. The voltage at Junction J3 of the voltage divider is fed to the other terminal of differential amplifier A3.

A pulse generator P intermittently closes switch S1, such as for 1 second every five minutes. The output of amplifier A3, if any, is fed to amplifier A5, level detector A6, a first terminal of AND gate G2, time delay T2 and counter C1. The counter output is fed to the second input of OR gate G1.

The second terminal of AND gate G2 is connected to the output of the pulse generator so that a pulse arrives at said second terminal while any output signal from amplifier A3 resulting from the previous pulse still exists at the output of time delay T2, as will be more fully described hereinafter.

Figure 2:
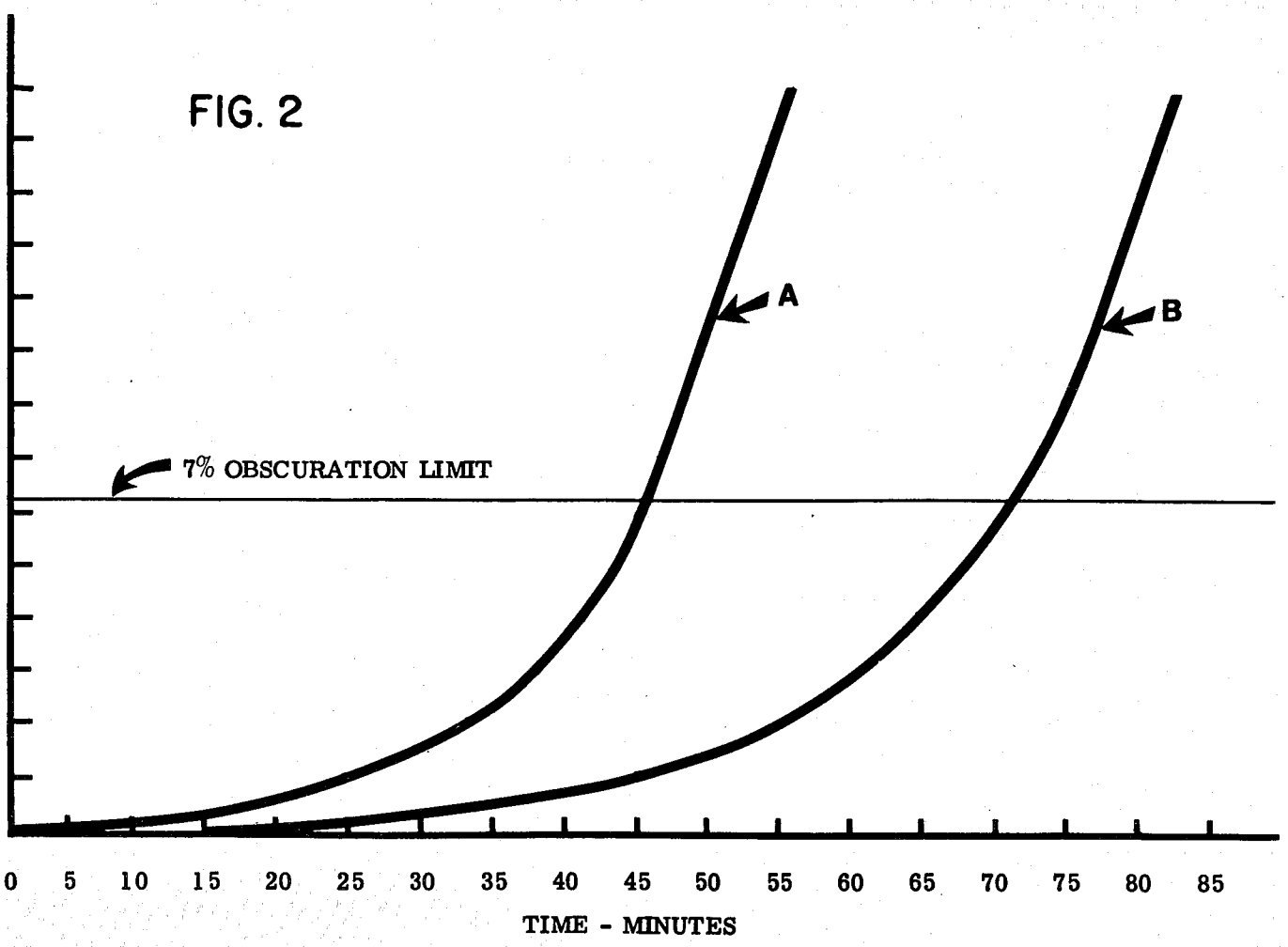
FIG. 2 is a graph illustrating smoke concentration vs. time required for an industry standard test of ionization detectors exposed to slow smouldering fires.

Referring to FIG. 2, there is illustrated a graph representing smoke density vs. time, which is used as a test standard by an industry testing organization. Curves A and B represent, respectively, the maximum and minimum limits allowed in the rate of increase of smoke concentration in a standard test of the response of ionization detectors to slow smouldering fires. In other words, during the test, the increase in smoke concentration with time must fall between curves A and B for the test to be valid, and the detector must alarm before the smoke obscuration exceeds 7%.

As can be seen from this curve, if the rate of smoke increase is at or near the minimum rate permitted in the test, then an alarm will not occur in the detector under test for at least 70 minutes.

The circuit of the second channel is intended to reliably provide an alarm in less than ½ the time allowed by the above described slow smouldering fire test, by detecting the rate of increase of smoke concentration over predetermined time intervals as will now be described.

Assuming that the supply voltage is 9 volts, and that the measuring electrode voltage during nonsmoke conditions is 5 volts, then a steady voltage of 2.5 volts appears at the first input of differential amplifier A3. On a first pulse P1 of the pulse generator P, the closing of switch S1 applies 5 volts to the capacitor F1 and therefore 2.5 volts is applied to the second terminal of differential amplifier A3 through buffer amplifier A4. This voltage will remain constant at said second terminal until at least the next pulse, whereas the voltage at the first terminal of A3 can fluctuate with any changes in voltage of the measuring electrode.

In a particular embodiment of the invention the differential amplifier A3 is designed and calibrated to produce an analog output which is a function of the difference between the voltages at the two inputs thereof. During standby nosmoke conditions, there will be a substantially constant 2.5 volts at each input, and therefore no output.

If smoke in increasing concentration enters the detector chamber, the voltage of the measuring electrode will drop an amount which is a function of the smoke concentration, and therefore the voltage at the first input of A3 will drop. Since the voltage at the other input of A3 is being maintained at 2.5 volts by capacitor F1, a voltage will appear at the output of A3 which is a function of the difference between the two input voltages. This output voltage from A3 is applied to amplifier A5, where it is amplified by a factor of 10, for example, and this amplified output voltage is applied to the level detector A6. If the change in smoke concentration during the interval between pulses, as represented by the measuring electrode voltage, is great enough, a "high" output from the level detector is applied to the first input of AND gate G2 through the time delay T2.

At the termination of the pulse interval, the next pulse P2 from the pulse generator P provides a "high" input pulse to the second terminal of AND gate G2, allowing a "high" output from the time delay T2 to be transferred to the counter C1, advancing the counter one step.

The pulse P2 also again momentarily closes switch S1, so that capacitor F1 is connected to the output of buffer amplifier A1. Since the output voltage of A1 is now lower than the voltage on capacitor F1, the capacitor F1 will partially discharge through amplifier A1 and assume the new lower output voltage of amplifier A1, which it will maintain during the following pulse interval.

If the smoke concentration thereafter continues to increase, the voltage on the first input of A3 will continue to drop, while the voltage at the second input remains constant at the new lower value. If the voltage on the measuring electrode drops far enough, during the interval after pulse P2 and the subsequent pulse P3, a "high" output from the lever detector A6 will result, and at the end of the pulse interval the next pulse P3 will allow a second "high" pulse to counter C1, advancing the counter another step.

The counter may be adjusted to provide a "high" output to the OR gate G1 after it has received a desired number of input pulses. In the illustrated embodiment the counter is adjusted to provide an output to the OR gate after it has received three input pulses.

In the event that a clock pulse at G2 is not accompanied by a "high" output from T2, a reset pulse is applied to the counter in a manner now to be described.

An OR gate G3 is provided with a first input from the output of an AND gate G4 and a second input from the junction J3 of a capacitor F2 and a resistor R4 across the power source V. The output of the OR gate G3 is connected to the reset terminal R of the counter C1.

The AND gate G4 has a first input from the gate G2 through an inverter A7 and a second input from pulse generator P through a pulse stretcher PS.

When the detector is first powered by the power source V, capacitor F2 provides a momentary "high" signal at junction J3, so that a momentary "high" input is provided to the second terminal of OR gate G3, which provides a momentary "high" output to the reset terminal R of the counter C1, thus insuring that the counter is reset to zero each time the detector is energized. After the initial momentary voltage, the capacitor F2 becomes fully charged and the voltage across resistor R4 drops to zero.

In the absence of smoke, when a pulse from pulse generator P arrives at the second terminal of AND gate G2, the voltage at the first input is "low" and therefore the output of G2 is "low" and the counter C does not register a count. This "low" output signal of G2 is also an input to the inverter A7, causing a "high" output from A7 to the first input of AND gate G5, at the same time that a "high" pulse from the pulse generator arrives at the second input of gate G4. A "high" output from G4 provides a "high" input to OR gate G3, causing a "high" output to the reset terminal R of the counter.

Thus each pulse from the pulse generator P causes the counter to reset, unless there is a signal at the output of T2, as will now be described.

If a "high" pulse from pulse generator P to the second terminal of the AND gate G2 occurs while a "high" signal from time delay T2 resulting from an increase in smoke concentration exists on the first input of G2, the resulting "high" output of G2, in addition to advancing counter C1 one count, also provides a "high" input to inverter A7. The resulting "low" output from A7 to the first input of gate G4 causes a "low" output from G4 to OR gate G3, so that the G3 output is "low" and the counter is not reset.

Thus on each pulse, the counter is reset to zero by the pulse to G4 unless a signal caused by an increase in smoke concentration exists at the time delay T2, in which case the presence of the smoke signal prevents the pulse from resetting the counter.

Referring to FIG. 2 of the drawing, the detector disclosed herein can be provided with circuit parameters that will allow it to respond to the rate of change of smoke concentration defined by the portion of curve B between 15 and 35 minutes, which is the slowest rate of change on the curve. Therefore if, as previously described, the pulse rate is 1 every five minutes, a first output pulse could occur at least as early as early as 20 minutes, in which case an alarm can be obtained at the end of 30 minutes.

If the detector can respond in 30 minutes or less to a slow rate of smoke build up, then it will respond much sooner to a faster rate of smoke buildup, such as is represented by curve A.

It is, of course, possible, but unlikely, that a smouldering fire can produce sufficient smoke to provide 7% obscuration without reaching the rate of increase to which the second channel of the detector can respond. However in such case the first channel will produce an alarm.

It is also possible for a smouldering fire to have a rate of increase of smoke concentration less than that of curve B, so that the 7% obscuration level is not reached for perhaps hours. However, if the rate of increase of smoke concentration is great enough at any time to provide three consecutive output signals, the alarm will be actuated.

The time of five minutes between pulses is arbitrary, and may be varied as desired. A shorter time between pulses will require that the second channel produce an output at a lesser change in smoke concentration that is required with 5 minute pulses, and may be more prone to false alarms, however an alarm will be obtained in a shorter time.

Since certain changes apparent to one skilled in the art may be made in the herein described embodiments of the invention without departing from the scope thereof, it is intended that all matter contained herein be interpreted in an illustrative and not a limiting sense.

I claim:

1. A smoke detector of the ionization type comprising a chamber containing a measuring electrode, the voltage on the measuring electrode being a function of the smoke concentration in the chamber, means responsive to a predetermined change in smoke concentration in a predetermined time in the chamber to produce an output signal to one input of an AND gate, pulse generating means providing an intermittent signal at the other terminal of the gate, a counter, means responsive to simultaneous pulse and output signals at the gate inputs to advance the counter one count, said counter having a reset terminal, means applying each pulse to the reset terminal except when the gate produces an output, and means responsive to accumulation in said counter of more than two counts for energizing alarm means.

2. A smoke detection system comprising a smoke detector of the ionization type and comprising a chamber and a measuring electrode in the chamber, the voltage on the measuring electrode being a function of the smoke concentration in the chamber, alarm means and a signal processing channel responsive to the rate of increase of smoke concentration sensed by said detector connected in circuit between said smoke detector and said alarm means comprising pulse generating means, sample and hold circuit means responsive to said pulse generating means for storing a reference smoke concentration value as a function of the voltage on said measuring electrode, comparator means responsive to a predetermined offset voltage on said measuring electrode from said stored reference value for generating an interim signal and updating the reference value stored in said sample and hold circuit means to the current output voltage on said measuring electrode, counter means for accumulating said interim signals, and means responsive to accumulation in said counter means of a plurality of said interim signals for energizing said alarm means.

3. A smoke detector as set out in claim 2 in which an AND gate having two inputs and one output is provided between said comparator means and said alarm actuating means, the output of said comparator means being connected to one input of the AND gate and the output of said pulse generating means being connected to the other input of said AND gate, the output of the AND gate being connected to said alarm actuating means, whereby the gate is opened to produce an output to said alarm actuating means only when an output signal from said comparator means and the next pulse from said pulse generating means exist simultaneously at the inputs of said AND gate.

4. A smoke detector as set out in claim 3 in which said counter means has a reset terminal, and further including means for applying a reset signal to said reset terminal on each pulse from the pulse generating means unless a said interim signal from said comparator means exists.

5. A smoke detector system comprising a smoke detector, said detector having an output as a function of the sensed smoke concentration, alarm actuating means, and a signal processing channel responsive to the rate of increase of smoke concentration sensed by said detector connected in circuit between said detector and said alarm actuating means comprising means for storing a reference smoke concentration value as a function of the output of said detector, means responsive to a detector output signal indicating an increase in smoke concentration from said stored reference value for generating an interim signal and concurrently updating the stored reference value to the current smoke concentration output of said detector, accumulator means for accumulating said interim signals, and means responsive to accumulation of a plurality of said interim signals by said accumulator means for energizing said alarm actuating means.

6. The smoke detector of claim 5 wherein said accumulator means is a counter, and further including means for periodically generating a sampling pulse, each said sampling pulse (1) causing said channel to produce said interim signal when said detector indicates an increase in smoke concentration from said stored reference value, (2) updating said stored reference value, (3) advancing said counter one count in the presence of said interim signal, and (4) clearing said counter in the absence of said interim signal: and means responsive to accumulation in said counter of more than two counts for energizing said alarm actuating means.

7. The smoke detector of claim 6 and further including a second signal processing channel connected in circuit between said detector and said alarm actuating means, said second signal processing channel being responsive to the absolute value of smoke concentration sensed by said detector and energizing said alarm actuating means in response to a predetermined smoke concentration value.

* * * * *

UNITED STATES PATENT OFFICE

CERTIFICATE OF CORRECTION

Patent No. 4,455,553 Dated June 19, 1984

Inventor(s) Robert E. Johnson

It is certified that error appears in the above-identified patent and that said Letters Patent are hereby corrected as shown below:

Col. 2, line 45, "FIG. 2" should be --FIG. 3--

Col. 2, line 67, "nonsmoke" should be --nosmoke--

Signed and Sealed this

*Twelfth* Day of *February 1985*

[SEAL]

*Attest:*

DONALD J. QUIGG

*Attesting Officer* *Acting Commissioner of Patents and Trademarks*